US007384341B2

(12) United States Patent
Martin et al.

(10) Patent No.: US 7,384,341 B2
(45) Date of Patent: Jun. 10, 2008

(54) PARLOR GAME

(75) Inventors: John R. Martin, Rockford, IL (US); Patrick G. Rice, Loves Park, IL (US); Thomas Myers, Machesney Park, IL (US); Richard F. Jones, Rockford, IL (US)

(73) Assignee: Arachnid Inc., Rockford, IL (US)

( * ) Notice: Subject to any disclaimer, the term of this patent is extended or adjusted under 35 U.S.C. 154(b) by 779 days.

(21) Appl. No.: 10/737,054

(22) Filed: Dec. 16, 2003

(65) Prior Publication Data

US 2004/0127283 A1 Jul. 1, 2004

Related U.S. Application Data

(60) Provisional application No. 60/434,222, filed on Dec. 17, 2002.

(51) Int. Cl.
*A63D 15/00* (2006.01)
*A63D 15/20* (2006.01)

(52) U.S. Cl. ..... 473/27; 700/92

(58) Field of Classification Search ..... 473/1, 473/4, 17, 23, 24, 25, 27; 700/92
See application file for complete search history.

(56) References Cited

U.S. PATENT DOCUMENTS 4,516,770 A * 5/1985 Brookes et al. ..... 473/23
5,026,053 A * 6/1991 Paterson et al. ..... 473/23

FOREIGN PATENT DOCUMENTS

AU 199944623 B2 3/2000

* cited by examiner

*Primary Examiner*—Scott E Jones
(74) *Attorney, Agent, or Firm*—McAndrews, Held, & Malloy, Ltd.

(57) ABSTRACT

A method is disclosed for initiating game play on a pay-for-play parlor game, such as a pool table having a playing surface, rails, pockets, a ball holding rack that retains pool balls, and an internal activation-sensing unit. The method includes depositing a game play fee into a remote activation assembly, remotely transmitting an activation signal once the game play fee is deposited, receiving the activation signal at the internal activation-sensing unit, and providing access to the pool balls upon said receiving step. A method is also disclosed for automatically scoring a pool-based game including detecting detectable devices embedded within the pool balls.

18 Claims, 4 Drawing Sheets

PARLOR GAME

RELATED APPLICATIONS

This application relates to and claims priority benefits from U.S. Provisional Patent Application No. 60/434,222 entitled "Improved Pool Table," filed Dec. 17, 2002, which is hereby incorporated by reference in its entirety.

BACKGROUND OF THE INVENTION

Embodiments of the present invention generally relate to parlor games, and more particularly to an improved system and method of activating a pay-for-play parlor game, and automatically calculating a score of a pool-based game.

Coin operated pool tables (or pay-for-play pool tables) are widely used for a variety of pool games, such as eight ball, nine ball, snooker, and the like. Typically, a player hits a cue ball with a pool cue in an attempt to knock the cue ball into solidcolored and striped numbered balls. Depending on the rules of the particular pool game, a player "scores" by sinking the appropriate balls into pockets of the pool table.

In order to begin playing a game of pool, a player typically inserts coins into a coin acceptor located on the pool table. Once an amount sufficient to play a game is inserted, a holding rack that retains the colored balls within the pool table is opened, thereby allowing a player to access the balls. The balls are then placed on the playing surface of the pool table in order to begin play.

Typical pay-for-play pool tables only include a coin acceptor, but not a bill acceptor. This is because the use of a bill acceptor requires increased power and space. One of the obstacles to providing power to such bill acceptors is that most pool tables require unobstructed access from all sides of the table for game play. Further, a pool table usually requires a generous amount of floor space surrounding a table for game play. Electrical wires or cabling passing from the pool table to a wall outlet are obtrusive and pose tripping problems.

Additionally, typical pool games are manually scored. Scoring games manually, however, may be inexact due to human error. Further, keeping track of scoring represents one more thing to be cognizant of during a game, and may be distracting to a player.

Thus, a need exists for a system and method of activating a pay-for-play pool table that is more efficient and user-friendly. Further, a need exists for a system and method of automatically scoring a pool game.

SUMMARY OF THE INVENTION

Embodiments of the present invention provide a pool table system that allows a user to play pool upon receipt of a playing fee. The system includes a pool table having a playing surface, rails, pockets, a ball holding rack that retains pool balls, and an activation-sensing unit, and a remote activation assembly having a processor operatively connected to a currency acceptor, which is adapted to receive coins and bills.

The remote activation assembly transmits an activation signal that is received by the activation-sensing unit within the pool table when the processor detects receipt of the playing fee, and wherein said activation-sensing unit is operable to allow a user to access said pool balls when said activation-sensing unit receives the activation signal. The remote activation assembly may be mounted on a wall, or it may be supported by a floor. Additionally, the remote activation assembly and activation-sensing unit may include antennae that wirelessly receive power signals from a commercial radio station The activation-sensing unit may be operatively connected to a gate positioned at an end of the holding rack. The activation-sensing unit acts to open the gate when the activation-sensing unit receives the activation signal. The currency acceptor is adapted to receive coins and bills.

Embodiments of the present invention also provide a method for initiating game play on a pay-for-play pool table having a playing surface, rails, pockets, a ball holding rack that retains pool balls, and an internal activation-sensing unit. The method includes depositing a game play fee into a remote activation assembly, remotely transmitting an activation signal once the game play fee is deposited, receiving the activation signal at the internal activation-sensing unit, and providing access to the pool balls upon the receiving step.

Embodiments of the present invention also provide a pool table system that is configured to automatically score a pool-based game. The system includes a pool table having a playing surface, rails, pockets, and pool balls, wherein each of the pool balls includes a detectable feature. The system also includes a scoring processor, and a ball detection sensor in communication with the scoring processor.

The ball detection sensor is positioned such that the pool balls pass by the ball detection sensor after the pool balls enter the pockets. The ball detection sensor detects the detectable feature as the pool balls pass by the ball detection sensor. The ball detection sensor relays a data signal to the scoring processor as the pool balls pass by said the detection sensor.

Each of the detectable features outputs a unique signal for each of the pools balls. The embedded detectable device may include at least one of an antenna, microchip, metallic security tag, magnet, and an ultrasonic emitter. Optionally, the detectable feature may be a unique marking, such as a bar code, number, color scheme/configuration or the like, that is detected by an optical sensor. The scoring processor distinguishes among the pool balls based on the data signals received.

Embodiments of the present invention also provide a method of automatically scoring a pool-based game played on a pool table having a playing surface, rails, pockets, and pool balls having embedded detectable devices therein. The method includes locating a ball detection sensor at a position where the pool balls pass after the pool balls enter the pockets, detecting the embedded detectable devices within the pool balls as the pool balls pass by the ball detection sensor, and relaying a data signal based on the detecting to a scoring processor.

Additionally, embodiments of the present invention provide a method of manufacturing a pool game system that is configured to automatically score a pool-based game, wherein the pool game system comprises a pool table having pool balls positioned over a playing surface bounded by rails and pockets. The method includes embedding detectable devices within the pool balls, wherein each of the pool balls includes one embedded detectable device that outputs a signal that is unique from output signals of other detectable devices embedded in other pool balls. The method also includes disposing ball-detecting sensors configured to detect the detectable devices at a position where the pool balls pass after the pool balls enter the pockets.

Further, embodiments of the present invention provide a pay-for-play parlor game system that enables game play upon receipt of a playing fee. The system includes a game unit having a playing surface and an activation-sensing unit, and a remote activation assembly. The remote activation assembly includes a processor operatively connected to a currency acceptor. The remote activation assembly transmits an activation signal that is received by the activation-sensing unit when the processor detects receipt of the playing fee. The activation-sensing unit is operable to allow a user to initiate game play when the activation-sensing unit receives the activation signal. The game unit may be a pool table, a foosball table, an air hockey table, a basketball-based game, a football based game, a hockey-based game (such as table hockey), and other such games commonly found in bars and arcades.

Figure 1:
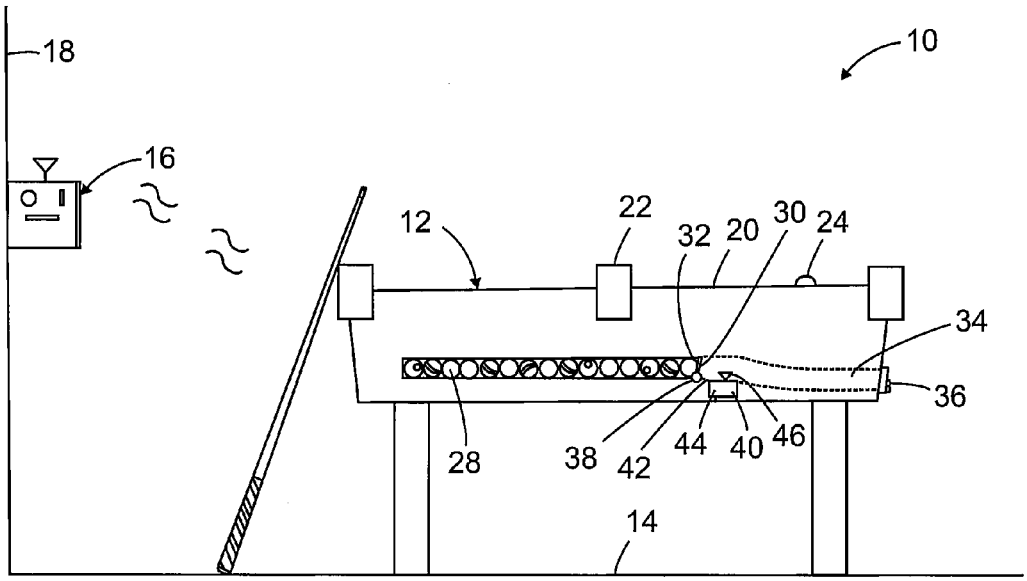
FIG. 1 illustrates a simplified representation of a pool system according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a simplified representation of a pool system 10 according to an embodiment of the present invention. The system 10 includes a pool table 12 supported by a floor 14, and a remote activation assembly 16 mounted on a wall 18. Optionally, the remote activation assembly 16 may be an upright, stand-alone unit supported by the floor 14, or mounted to the underside of the pool table 12.

The pool table 12 may be a standard pool table including a felt playing surface (not shown) bounded by rails 20 (or bumpers) and pockets 22. As shown in FIG. 1, a cue ball 24 is positioned on the playing surface. The pool table 12 also includes a ball retention compartment, or holding rack, 26. The ball retention compartment 26 is connected to the pockets 22 through internal pathways (not shown) that allow numbered striped and colored balls 28 to pass from the pockets 22 into the ball retention compartment 26. A gate 30 is positioned at an outlet 32 of the ball retention compartment 26.

The gate 30 is normally in a closed position so that the balls 28 are retained within the ball retention compartment 26 and not allowed to pass into the ball delivery passage 34 (which is within the main body of the pool table 12). The ball retention compartment 26 may be sloped slightly downward, so that when the gate 30 is opened, the balls 28 pass into the ball delivery passage 34 by way of gravity. The ball delivery passage 34 is connected to an access area 36, at which a player may remove the balls 28 from the pool table 12 and proceed to place them on the playing surface in order to play pool.

The gate 30 is operatively connected to an opening device 38, such as a solenoid, latch, clasp, or the like, that is configured to open and close the gate 30. The opening device 38 is in turn electrically connected to an activation-sensing unit 40 through wiring 42. The activation-sensing unit 40 includes a processor 44, or other such device capable of sensing a received signal and acting thereupon, electrically connected to a receiving antenna 46 and the opening device 38. The activation-sensing unit 40 wirelessly receives signals, such as radio frequency (RF) signals from the remote activation assembly 16 by way of the receiving antenna 46. The processor 44 analyzes the received signals to determine whether to open the gate 30 in order to allow play to begin. That is, the remote activation assembly 16 sends an activation signal to the activation-sensing unit 40 instructing the activation-sensing unit 40 to open the gate 30 to allow players to gain access to the balls 28 through the access area 36. If the remote activation assembly 16 does not send an activation signal to the activation-sensing unit 40, the gate 30 remains closed.

Figure 2:
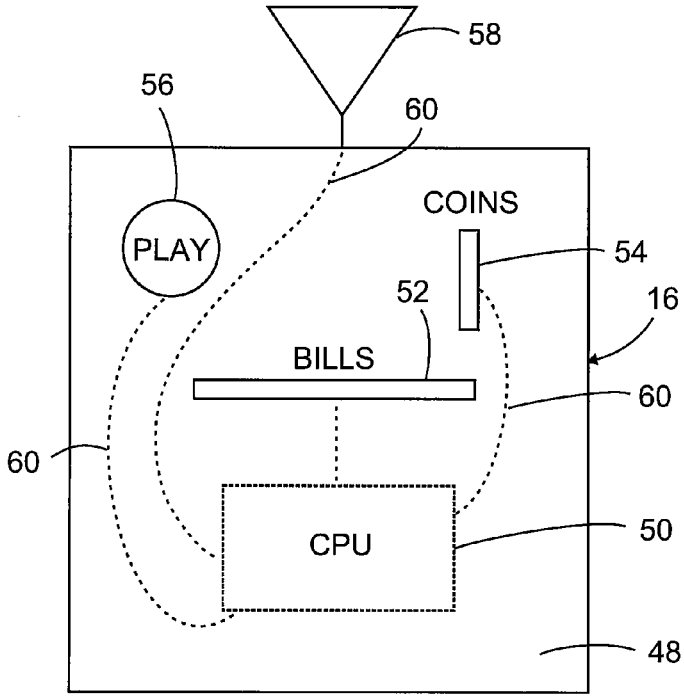
FIG. 2 illustrates a schematic diagram of a remote activation assembly according to an embodiment of the present invention.

FIG. 2 illustrates a schematic diagram of a remote activation assembly 16. The remote activation assembly 16 includes a main body 48 housing a central processing unit 50 therein. The central processing unit (CPU) 50 is electrically connected to a bill acceptor 52, a coin acceptor 54, a play activation button 56, and a transmitting antenna 58, through internal wiring 60. While the transmitting antenna 58 is shown external to the main body 48, the transmitting antenna 58 may be housed within the main body 48 (similarly, the receiving antenna 46 of the activation-sensing unit 40 may be housed within a main body of the activation-sensing unit 40).

The remote activation assembly 16 is powered by way of the transmitting antenna 58 receiving radio signals from a commercial radio station. Further, the activation-sensing unit 40 may be powered by way of the receiving antenna 46 receiving radio signals from a commercial radio station. Optionally, a capacitor of sufficient storage size may be housed within the activation-sensing unit 40 in order to provide power. Further, a capacitor may be housed within the main body 48 of the remote activation assembly 16 and electrically connected to the CPU 50. Alternatively, the remote activation assembly 16 may be electrically connected to a standard electrical outlet, or it may be battery powered.

Figure 7:
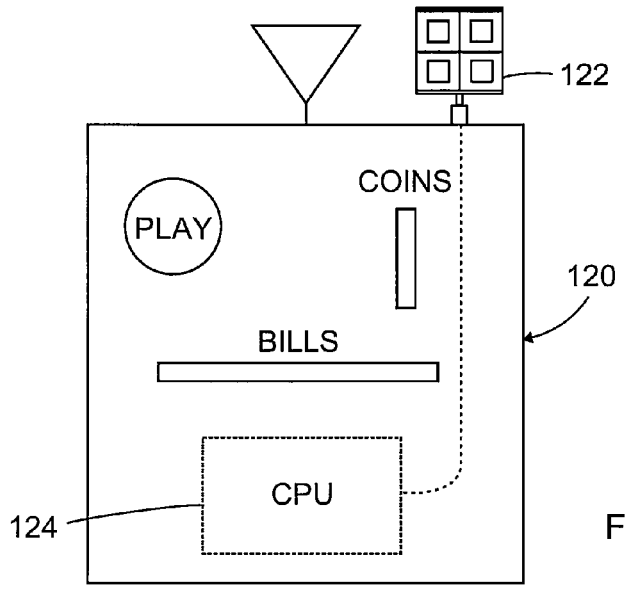
FIG. 7 illustrates a remote activation assembly according to an alternative embodiment of the present invention.

FIG. 7 illustrates a remote activation assembly 120 according to an alternative embodiment of the present invention. The remote activation assembly 120 includes a solar cell 122 that is in electrical communication with the CPU 124. The remote activation assembly 120 may be powered through solar power. The solar cell 122 may be mounted at various positions of the remote activation assembly and may be electrically connected to an internal power reservoir, the coin/bill acceptor, and the like. Similarly, the activation-sensing unit 40 may also be electrically connected to, and receive power from, a solar cell.

Referring again to FIGS. 1 and 2, a player inserts currency into the remote activation assembly 16 through the bill acceptor 52 and/or the coin acceptor 54. Once the currency is input into the remote activation assembly 16, the CPU 50 determines the amount entered. If the input amount is sufficient for game play, the CPU 50 sends an activation signal to the activation-sensing unit 40 through the transmitting antenna 58 when the play button 56 is depressed. The activation-sensing unit 40 then opens the gate 30, thereby causing the balls 28 to pass to the access area 36. If the input amount is insufficient for game play, the CPU 50 does not send an activation signal to the activation-sensing unit 40.

Figure 3:
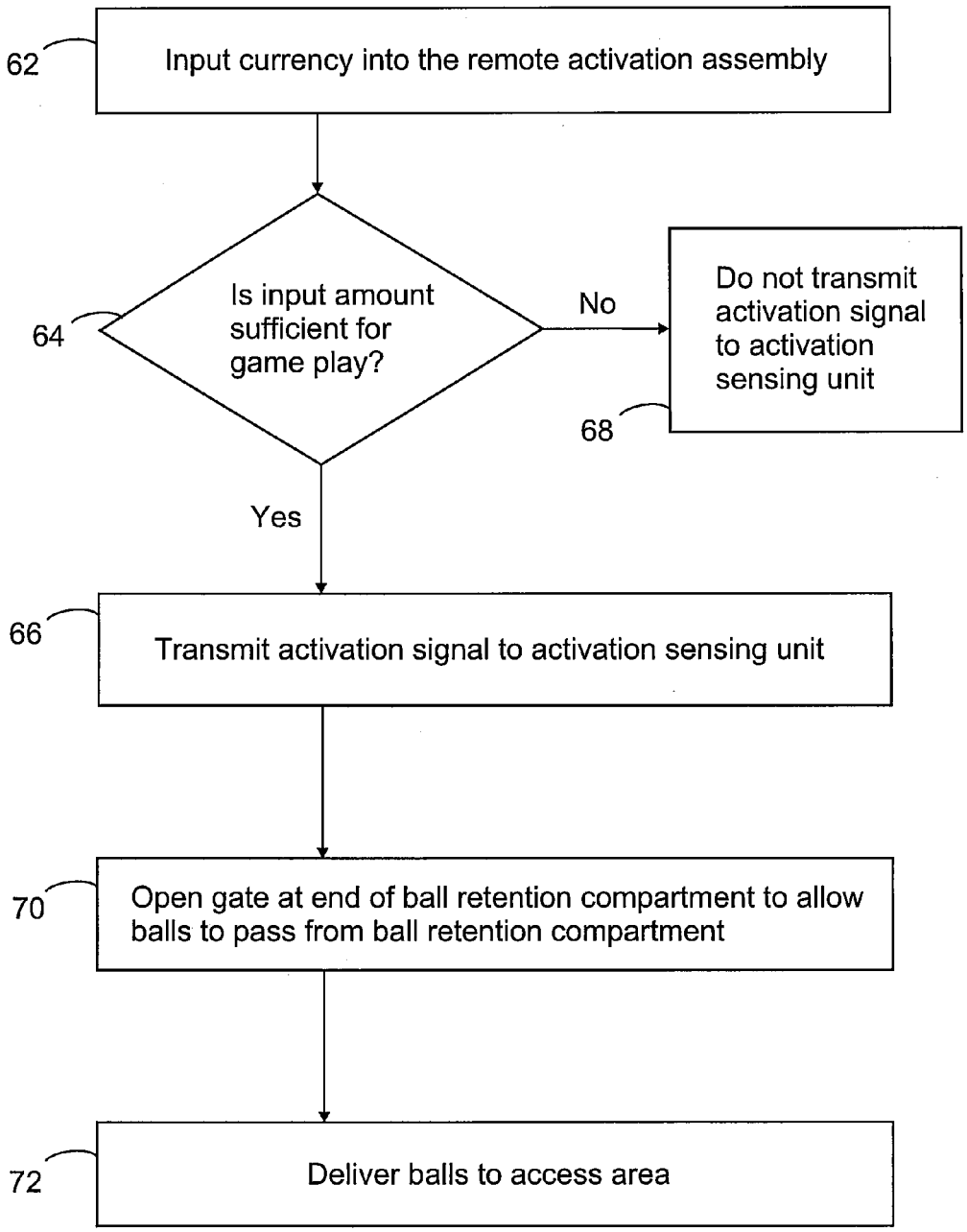
FIG. 3 illustrates a flow chart for a method of activating a pool system according to an embodiment of the present invention.

FIG. 3 illustrates a flow chart for activating a pool system 10 according to an embodiment of the present invention. At 62, a player inputs currency into the remote activation assembly 16. At 64, the remote activation assembly 16 determines whether the input amount is sufficient for game play. If the amount is sufficient, the remote activation assembly 16 transmits an activation signal to the activation-sensing unit 40, which is housed within the pool table 12 at 66. If, however, the amount is insufficient, the remote activation assembly 16 does not transmit an activation signal to the activation-sensing unit 40 at 68.

The activation-sensing unit 40 opens the gate 30 at 70 once it receives the activation signal. At 72, the balls 28 then pass to the access area 36 where a player may then remove the balls 28 from the pool table 12 and place the balls 28 on the playing surface.

Figure 4:
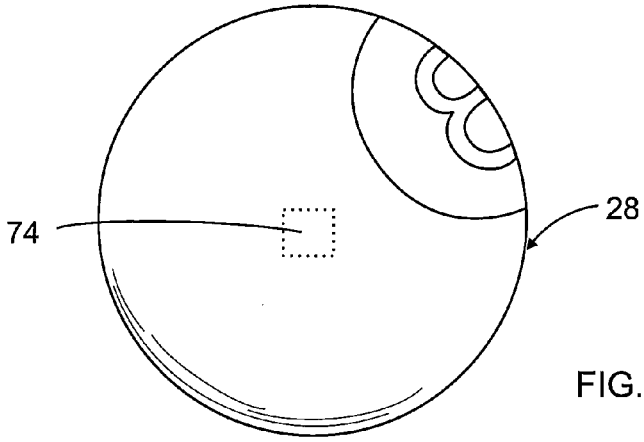
FIG. 4 illustrates a pool ball according to an embodiment of the present invention.

FIG. 4 illustrates a pool ball 28 according to an embodiment of the present invention. The pool ball 28 may be any pool ball (e.g., an 8-ball, 9-ball, cue ball, and the like). Embedded within the ball 28 is a detectable device 74. The detectable device 74 may be a transmitting or receiving antenna or microchip, a metallic security tag, a magnet, an ultrasonic emitter or sensor, or various other such devices capable of transmitting or receiving a signal in relation to a corresponding detector (e.g., a receiving or transmitting antenna, an electromagnetic sensor, an ultrasonic detector, and the like). Preferably, the detectable device 74 is a radio frequency coded antenna embedded within each ball 28 during a ball manufacturing process.

In order to ensure smooth and even movement of the pool ball 28, the detectable device 74 is preferably symmetrically positioned about the center of gravity of the pool ball 28. Optionally, the detectable device 74 may be various shapes and sizes and may be embedded within the pool ball 28 at various positions.

Figure 5:
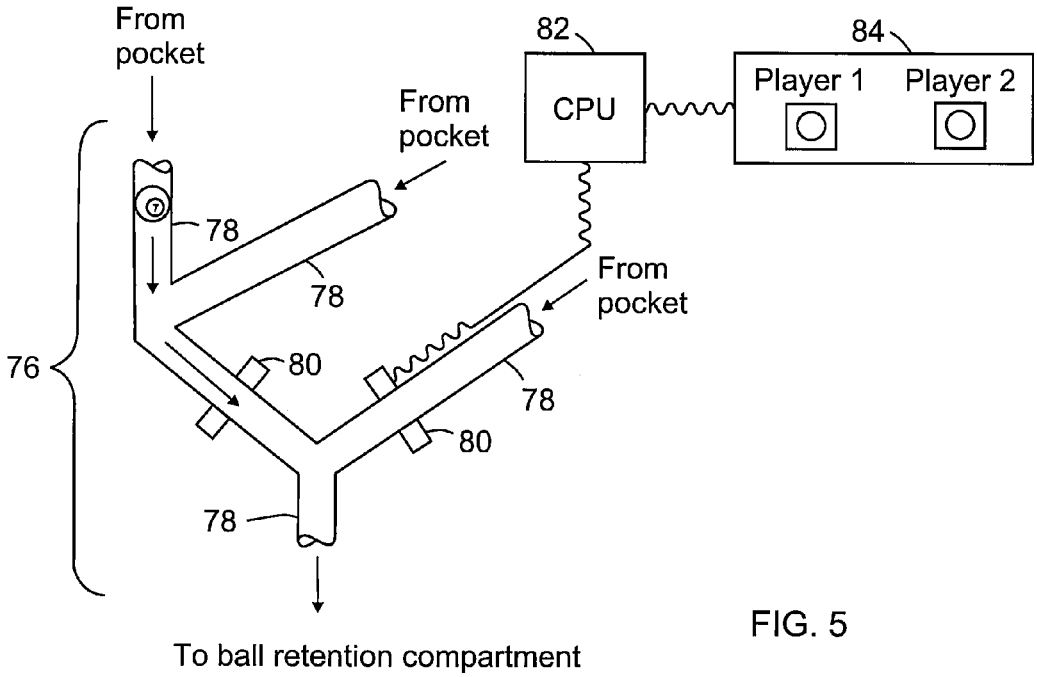
FIG. 5 illustrates a simplified representation of a ball return and scoring system according to an embodiment of the present invention.

FIG. 5 illustrates a simplified representation of a ball return and scoring system 76 according to an embodiment of the present invention. The system 76 is located within the main body of the pool table 12. The system includes a series of tubes, channels or the like (hereinafter "tubes") 78. The tubes 78 connect the pockets 22 to the ball retention compartment 26.

Ball sensors 80 are positioned over a portion of the tubes 78. Optionally, each pocket 22 may include a ball sensor 80. While two ball sensors 80 are shown, the system 76 may include more ball sensors 80. Optionally, the system 76 may include one ball sensor 80 located over the tube 78' that connects directly to the ball retention compartment 26. The sensors 80 are in communication with a central processing unit (CPU) 82, which is in turn in operative communication with a scoring display 84. The sensors 80 relay ball sensing data to the CPU 82 when the balls 78 pass through the sensors 80. The CPU 82 then analyzes the ball sensing data and displays scoring information based on the ball sensing data on the scoring display 84.

The sensors 80 may be radio frequency sensors that sense a radio frequency output of a detectable device 74 within a particular ball 28 as it passes through (or proximate) a sensor 80. Optionally, the detectable device 74 may be a magnet and the sensors 80 may be an electromagnetic sensing unit that detects the electromagnetic field produced by the magnet within the ball 28 as it passes through (or proximate) the sensor 80. Optionally, the sensors 80 may be configured to detect ultrasonic frequencies output by the detectable devices 74. Various types of detection systems may be used with various types of signal output devices known in the art. Each detectable device 74 may output a specific signal, such as a particular radio frequency. Thus, each ball 28 may include a detectable device 74 outputting a unique signal.

Alternatively, the balls 28 may be detected through optical sensors. Each ball 28 may include a particular distinguishing mark located somewhere on its outer surface. For example, the detectable device may be a bar code located on the surface of a ball 28. The distinguishing mark may also be the number on the ball and/or ball color or color configuration (e.g., striped or solid). Each ball may include a unique distinguishing mark that is distinct from marks on other balls. Each distinguishing mark may be associated with a particular ball. The sensors 80 may be optical sensors, such as laser, infrared emitters, or the like. The optical sensors may be capable of reading bar codes, numbers, and/or ball colors, stripes, and the like. The unique signal output may be the distinguishing mark that is detected by the optical sensor.

Regardless of the type of signal output by a ball 28 (e.g., an RF signal, a distinguishing mark, and the like), the CPU 82 correlates the unique signal with a particular ball 28. For example, the 8 ball may output a signal at a first radio frequency, while a cue ball may output a signal at a second frequency, and the 9 ball may output a signal at a third radio frequency, and so on. The CPU 82 distinguishes between balls 28 through the detection of different signals.

Figure 6:
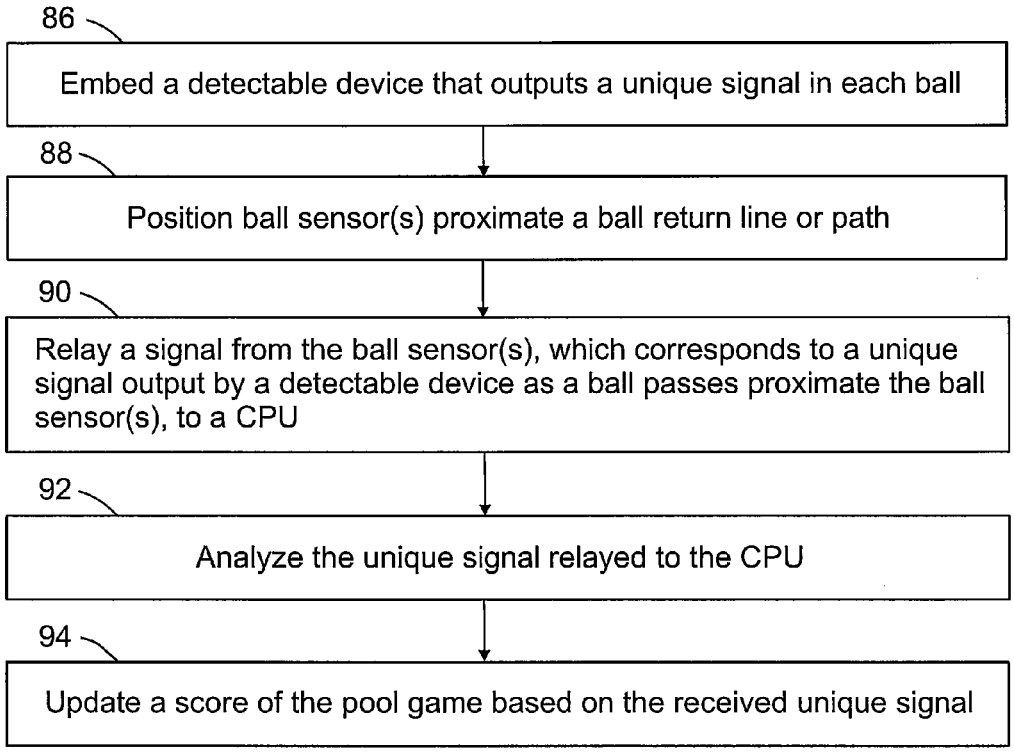
FIG. 6 illustrates a flow chart for a method of providing a pool table system that is capable of automatically scoring a game of pool according to an embodiment of the present invention.

FIG. 6 illustrates a flow chart for a method of providing a pool table system that is capable of automatically scoring a game of pool according to an embodiment of the present invention. At 86, pool balls 28 are manufactured with embedded detectable devices 74. Each detectable device 74 outputs a unique signal that is different than any other detectable device 74. Each ball 28 is associated with a unique signal that is output by a detectable device embedded within the particular ball 28.

A pool table is manufactured having at least one ball sensor 80 positioned proximate a ball return line at 88. As the pool balls 28 pass through the ball return line, the ball sensor(s) 80 relays a data signal indicative of the detectable device embedded within the pool ball 28 to a CPU 82 as the ball 28 passes by the ball sensor(s) 80 at 90. The CPU 82 then analyzes the received data signal and associates the received data signal with a particular pool ball 28 at 92. The CPU 82 then updates a game score based on the received data signal on a score display 84 at 94.

While the systems and methods discussed above relate to standard pool tables, embodiments of the present invention may be used with various types of pool-type games, including, but not limited to, billiards, snooker, and bumper pool. Additionally, embodiments of the present invention may also be used with foosball tables, basketball and football based games in which a player throws balls at a hoop and/or target, air or table hockey games, or various other parlor games commonly found in bars and arcades.

Thus, embodiments of the present invention provide a system and method for activating a pool table through a remote activation device. The remote activation device may accept coins or bills. Further, embodiments of the present invention provide a system and method for automatically scoring a game of pool.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A pool table system that allows a user to play pool upon receipt of a playing fee, said system comprising:

a pool table having a playing surface, rails, pockets, a ball holding rack that retains pool balls, and an activation-sensing unit; and a remote activation assembly having a processor operatively connected to a currency acceptor, wherein said remote activation assembly transmits an activation signal that is received by said activation-sensing unit when said processor detects receipt of the playing fee, and wherein said activation-sensing unit is operable to allow a user to access said pool balls when said activation-sensing unit receives the activation signal, wherein one or both of said remote activation assembly and/or said activation-sensing unit further comprises an antenna that wirelessly receives power signals from a commercial radio station, wherein the received power signals power one or both of said remote activation assembly and/or said activation-sensing unit.

2. The system of claim 1, further comprising:

ball return passages within said pool table that connect said pockets with said ball holding rack;

a scoring processor; and a ball detection sensor in communication with said scoring processor and located proximate a portion of at least one of said ball return passages, wherein each of said pool balls includes an embedded detectable device that outputs a unique signal for each of said pool balls, and wherein said ball detection sensor detects said embedded detectable devices as said pool balls pass by said ball detection sensor, and wherein said ball detection sensor relays a data signal to said scoring processor as said pool balls pass by said ball detection sensor, said scoring processor distinguishing among each of said pool balls based on the unique signals received.

3. The system of claim 1, wherein said activation-sensing unit is operatively connected to a gate positioned at an end of said holding rack, wherein said activation-sensing unit acts to open said gate when said activation-sensing unit receives said activation signal.

4. The system of claim 1, wherein said currency acceptor is adapted to receive coins and bills.

5. The system of claim 1, wherein said remote activation assembly is mounted on a wall.

6. The system of claim 1, wherein said remote activation assembly is supported by a floor.

7. The system of claim 1, wherein said activation signal is a radio frequency signal.

8. The system of claim 1, wherein said pool table is one of a standard pool, billiards, bumper pool and snooker table.

9. A method for initiating game play on a pay-for-play pool table having a playing surface, rails, pockets, a ball holding rack that retains pool balls, and an internal activation-sensing unit, said method comprising:

depositing a game play fee into a remote activation assembly;

remotely transmitting an activation signal once the game play fee is deposited;

receiving the activation signal at the internal activation-sensing unit;

providing access to the pool balls upon said receiving step; and providing power to one or both of the remote activation assembly and/or the internal activation-sensing unit through radio signals received from a commercial radio station.

10. The method of claim 9, wherein said providing access comprises opening a gate positioned at an end of said ball holding rack in order to allow the pool balls to pass therethrough.

11. The method of claim 9, wherein said depositing comprises depositing one or both of bills and/or coins into the remote activation assembly.

12. The method of claim 9, wherein the remote activation assembly is mounted on a wall.

13. The method of claim 9, wherein the remote activation assembly is supported by a floor.

14. The method of claim 9, wherein the activation signal is a radio frequency signal.

15. The method of claim 9, wherein the pool table is one of a standard pool, billiards, bumper pool or snooker table.

16. A pay-for-play parlor game system that enables game play upon receipt of a playing fee, said system comprising:

a game unit having a playing surface and an activation-sensing unit; and a remote activation assembly having a processor operatively connected to a currency acceptor, wherein said remote activation assembly transmits an activation signal that is received by said activation-sensing unit when said processor detects receipt of the playing fee, and wherein said activation-sensing unit is operable to allow a user to initiate game play when said activation-sensing unit receives the activation signal, wherein one or both of said remote activation assembly and/or said activation-sensing unit are powered through signals received from a commercial radio station.

17. The pay-for-play parlor game system of claim 16, wherein said game unit is a pool table.

18. The pay-for-play parlor game system of claim 16, wherein said game unit is one or more of a foosball table, an air hockey table, a basketball-based game, a football based game, and/or a hockey-based game.

* * * * *